United States Patent [19]

Gaddy

[11] Patent Number: 4,616,422

[45] Date of Patent: Oct. 14, 1986

[54] ELEVATED BOWHUNTERS SIGHT

[76] Inventor: Donald E. Gaddy, Rte. 1, Box 166, Callao, Mo. 63534

[21] Appl. No.: 795,181

[22] Filed: Nov. 5, 1985

[51] Int. Cl.[4] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 3,013,336 | 12/1961 | Pennington | 33/265 |
| 4,120,096 | 10/1978 | Keller | 33/265 |
| 4,368,581 | 1/1983 | Tullos | 33/265 |

*Primary Examiner*—Harry N. Haroian

*Attorney, Agent, or Firm*—Frank P. Cyr

[57] ABSTRACT

A bowhunter sight adapted solely to hunters shooting from an elevated position where the tendency is for the hunter to shoot high, thus missing the intended impact area of the designated target.

My invention is a counter-weighted wheel with an adjustable sight pin which is employed with a conventional sighting system that is used by most hunters. The conventional system consists of a bracket attached to the compound bow's riser, which is predrilled to accept the bracket. Also, on the front of the bracket are two slots to accept sighting pins which are set stationary at known yardages, Example—20 yards; 30 yards; 40 yards; 50 yards. The hunter than must estimate all yardages in between known yardage pins.

My invention attaches to the conventional sighting system and is to be used when hunting from an elevated stand. The single sight pin on the counter-weighted wheel automatically adjusts itself to all yardages covered, which is from base of stand to approximately 30 yards, depending somewhat on bow being used.

3 Claims, 7 Drawing Figures

ELEVATED BOWHUNTERS SIGHT

BACKGROUND OF THE INVENTION

Archery has long been used by sportsmen and hunters alike. However, the accuracy of the arrow for hitting a target, whether it be a stationary target or one likely to move shortly before impact of the arrow, has been most troublesome for the archer shooting from an elevated stand due to the downward angle that causes his arrow to hit higher on the target than shooting from ground level using same sight pin that is stationary set at the same yardages.

With the above in mind, it is the main objective of the invention to correct this deviation automatically using the sight pin on counter-weighted wheel when hunting from an elevated stand, such as a tree or the like, out to approximately 30 yards. The trajectory of the arrow prevents using the invention much over 30 yards due to its curve, and still be on target at all yardages in between 30 yards and base of stand. It has been estimated that the biggest percent of animals killed is under 30 yards, so the need for the invention to cover more yardage is somewhat remote.

Another objective of the invention, when properly set, is to give the archer's full concentration to the target instead of guessing which stationary pin to use, and how much to hold high or low on intended target. The one pin on wheel will rotate by means of counter-weighted wheel to correct yardage automatic out to approximately 30 yards eliminating guessing by the archer. When aiming, the archer looks through a peep sight in bow string like backsight on a rifle, and aligns sight pin on wheel like front sight on a rifle, to the intended target.

Another objective of the invention is to give windage adjustment by moving sight pin right or left on wheel to correctly calibrate sight pin to intended impact area of arrow. Thus, once calibrated, it is locked in place by means of two lock nuts, one on each side of wheel.

Another objective is to give elevation adjustment by moving sight pin in slot on wheel to correctly calibrate sight pin to intended impact area of arrow. Once calibrated, it is locked in place by same two lock nuts as windage adjustment. The closer to center of wheel raises elevation and opposite lowers it.

Another objective of the invention is to give no interference with aiming or adjusting stationary set pins on conventional slotted sight bracket, thus giving the archer the option to stalk game from ground level using conventional system or hunting from an elevated stand using the invention without removing or recalibrating either one of them.

Mounting of invention to conventional slotted slight bracket, which by no means is part of invention, will be apparent from a study of the following detailed description and the accompanying drawings.

DESCRIPTION OF THE PREFERRED EMBODIMENT

Figure 1:
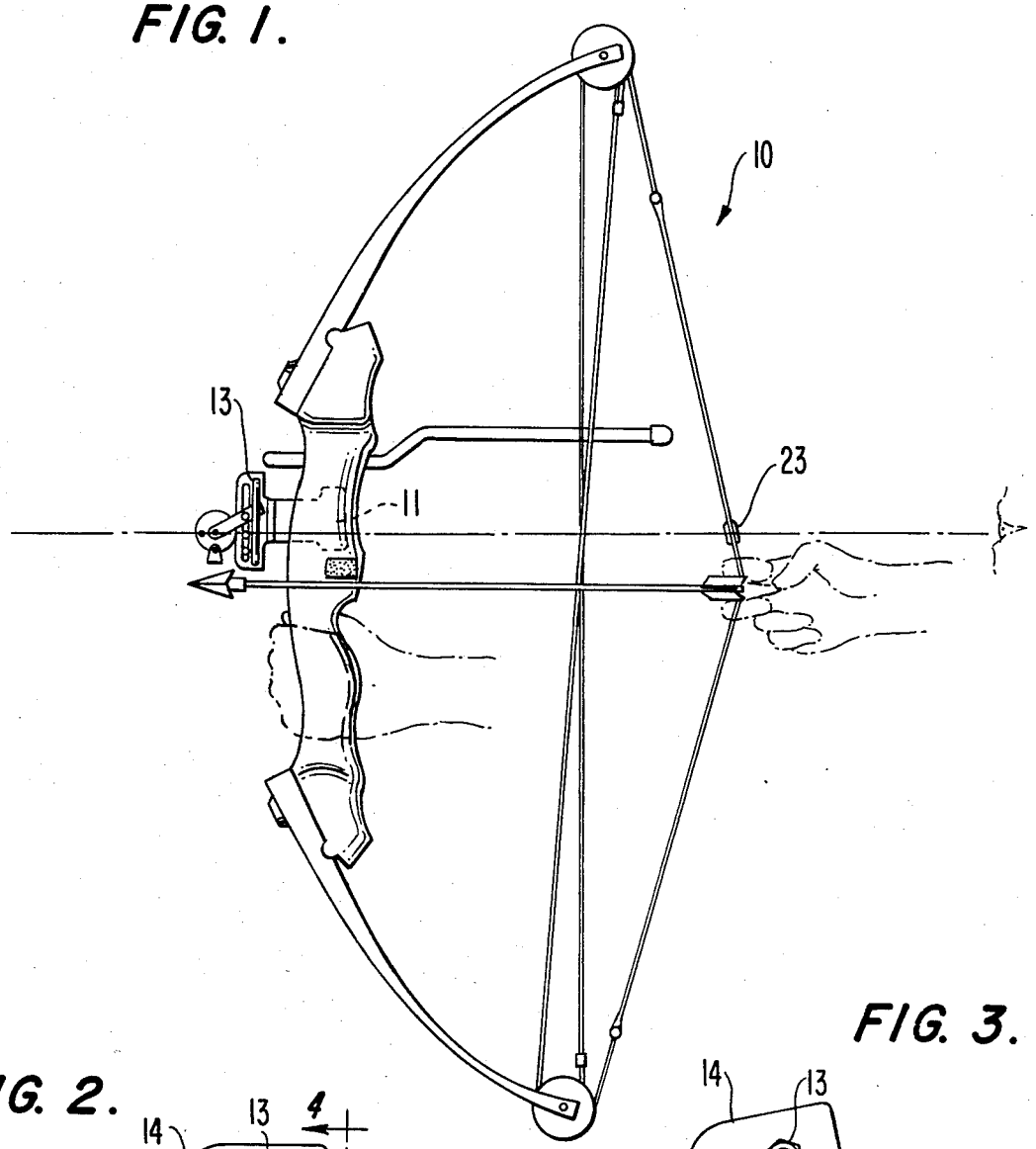
FIG. 1 is a side elevation of a conventional compound bow showing the invention mounted thereon.
Figure 2:
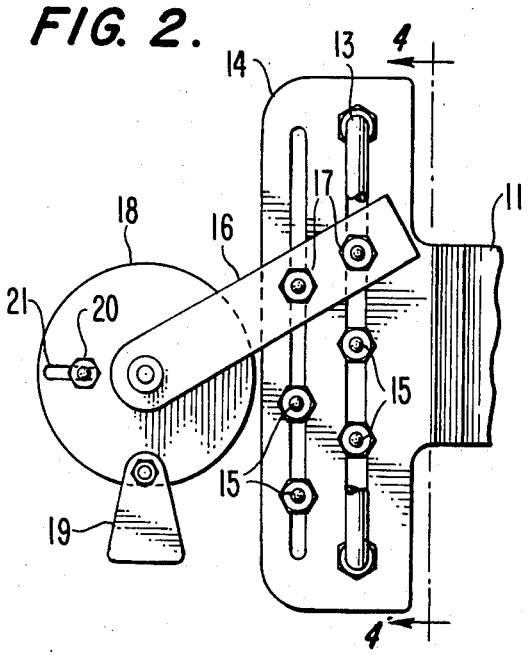
FIG. 2 is an enlarged fragmentary view of the attachment to a conventional compound bow.

Referring now to the drawings wherein like reference numerals are employed to designate like parts throughout the several views, 10 designates a conventional compound bow, although the invention could be adapted to other type bows.

The compound bow, conventional sight bracket and sight pins thereon, and peep sight is merely illustrative and forms no part of the present invention. 11 designates the base of a conventional slotted sight structure used on known compound bow structures, secured to the compound bow riser. Secured to plate 14 is the structure of the present invention by means of two bolts 17 to plate 14 of the conventional structure. Also, plate 14 carries a number of stationary sighting pins 15, and a brush guard 13. Sighting pins on plate 14 are set apart at a distance equivalent to the yardage between the archer and the intended target.

Figure 3:
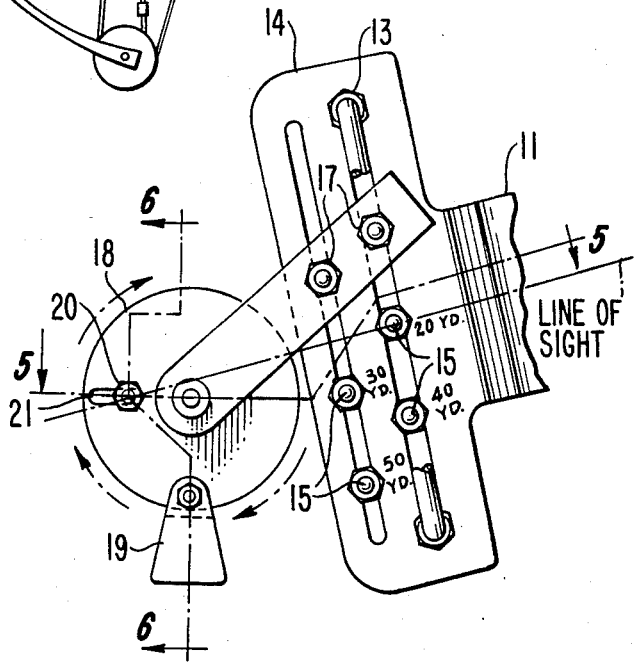
FIG. 3 is an enlarged fragmentary view of the attachment shown in an adjusted position.
Figure 4:
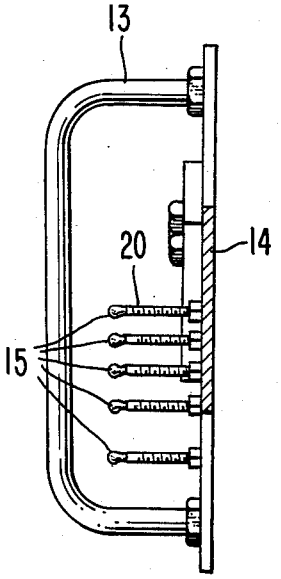
FIG. 4 is a section taken on lines 4—4 of FIG. 2, looking in the direction of the arrows.

A pair of bracket arms 16 of present invention are mounted on plate 14 and are secured thereto, as by means of bolts 17. As shown more clearly in FIG. 3 of the drawings, the stationary sighting pins are spaced along plate 14 which will have indicia markings thereon to designate the approximate yardage from the bow to the intended target.

Mounted for rotation on bracket arms 16 is a wheel 18 to which there is affixed a counterweight member 19. An adjustable sighting pin 20 extends into a slot 21 formed in the wheel 18 whereby the sighting pin may be adjusted therein.

Figure 6:
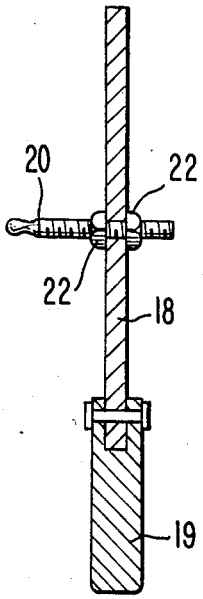
FIG. 6 is a section taken on lines 6—6 of FIG. 3, looking in the direction of the arrows.
Figure 7:
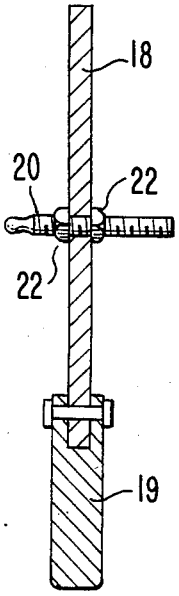
FIG. 7 is a view similar to FIG. 6, showing the adjustment for the windage as mounted on a pendulum wheel.
Figure 5:
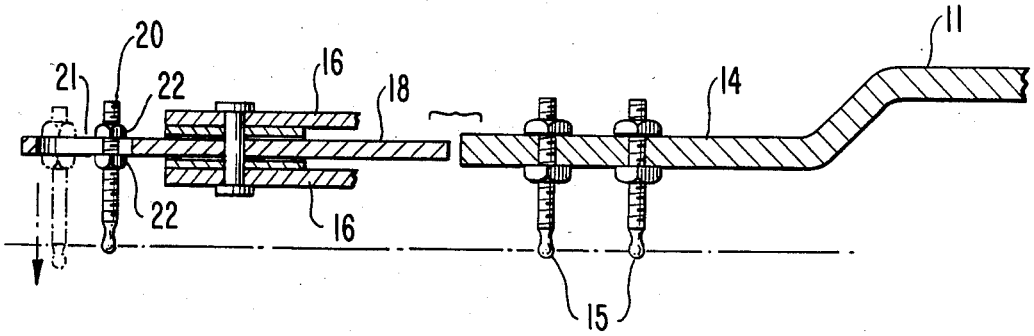
FIG. 5 is a section taken on lines 5—5 of FIG. 3, looking in the direction of the arrows.

The sighting pin 20 is retained in the slot 21 by means of lock nuts 22 which threadingly engage the threaded section of said sighting pin as is shown in FIG. 6 of the drawings.

To use the sight of the invention, the user must initially set up a stationary target at 20 yards from bow, then drawing bow to full draw and aligning peep sight 23 to 20 yard pin 15 of conventional sight, aim at target and adjust sight pin 20 on wheel 18 where it is directly behind sight pin 15 of conventional sight by moving bracket arms 16 up or down until it is directly behind sight pin 15 when bow is at full draw. The user then would calibrate windage by moving sighting pin 20 right or left using sighting pins 15 as a guide. All pins should be in a straight row. He then would test from an elevated stand at a target at all yardages from base to approximately 30 yards using sight pin 20, by aligning peep and sight pin 20 to target and shooting arrow. Once properly calibrated, wheel 18 will rotate to automatically correct the yardage covered when shooting from an elevated stand with the archer using only the one sighting pin 20 and not being concerned by yardages out to approximately 30 yards.

Elevation adjustments are calibrated by moving sighting pin 20 in slot 21 and shooting at a target 15 yards from base of elevated stand with impact area approximately 3 inches high as goal in mind.

Once calibrated, all lock nuts are secured in place. Due to the arch in trajectory of arrow flight, it is not possible to hit dead center of target at all yardages covered, but present invention use will be in tolerance of a 10 inch kill zone of yardages covered.

Thus, it will be seen that I have developed an improved sighting arrangement for a bow which will compensate one using the bow from an elevated position such as a stand in a tree or the like.

What I claim is:

1. A bow hunter sight adapted solely for one shooting from an elevated position, a wheel having a slot formed therein, an adjustable sighting pin mounted in said slot, a counter weight fixedly mounted on said wheel, and two mounting arms for journalling said wheel for rotation and which opposite ends of said arms mounts to most conventional sight plates.

2. The structure recited in claim 1 wherein said counter weight is fixedly mounted on said wheel to thereby rotate said wheel automatically to yardages covered, base of elevated stand to approximately 30 yards, depending somewhat on draw weight of bow being used.

3. The structure recited in claim 1 wherein said adjustable sighting pin on said wheel is capable of adjustment in said slot formed in said wheel for windage and elevation.

* * * * *